US006681424B1

(12) United States Patent
Bourgraf et al.

(10) Patent No.: US 6,681,424 B1
(45) Date of Patent: Jan. 27, 2004

(54) TILT-TOP MORTUARY COT

(75) Inventors: Elroy Edwin Bourgraf, Cincinnati, OH (US); Ronald Duane Vance, Sabina, OH (US); Eugene VanDyne, Wilmington, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 16 days.

(21) Appl. No.: 09/677,258

(22) Filed: Oct. 2, 2000

(51) Int. Cl.[7] ..... A61G 1/02
(52) U.S. Cl. ..... 5/611; 5/607; 5/625; 5/627
(58) Field of Search ..... 5/610, 611, 617, 5/625, 626, 627, 110, 607, 608; 296/20, 19

(56) References Cited

U.S. PATENT DOCUMENTS 2,234,483 A * 3/1941 Sutton ..... 108/7
2,542,963 A * 2/1951 Knox et al. ..... 5/86.1
3,644,944 A * 2/1972 Bourgraf et al. ..... 296/20
4,037,871 A * 7/1977 Bourgraf et al. ..... 296/20
4,274,168 A 6/1981 Depowski
5,022,810 A * 6/1991 Sherrow et al. ..... 414/501
5,036,557 A 8/1991 Fales
5,163,189 A * 11/1992 DeGray ..... 5/86.1
5,179,746 A * 1/1993 Rogers ..... 5/625
5,303,438 A * 4/1994 Walker ..... 5/652
5,765,243 A * 6/1998 Duncan et al. ..... 5/625

* cited by examiner

*Primary Examiner*—Teri Pham Luu
*Assistant Examiner*—Fredrick Conley
(74) *Attorney, Agent, or Firm*—Dinsmore & Shohl

(57) ABSTRACT

A cot for assisting in the transfer of a body from a removable support bed of the cot to another surface. The cot includes a trolley which serves as a transporter for the removable support bed. The cot also includes a tilting device which is designed to tilt the support bed about the trolley. The support bed may be removed from the trolley to reduce the total weight carried by the attendants, and permit the removal of a body from locations which are difficult to access. When removed from the trolley, the support bed may be rolled upright with wheels that are located at one end of the support bed. The support bed is contoured in shaped to pool bodily fluids which may escape during transport. A locking device is provided on the trolley for releasably securing the support bed thereon.

26 Claims, 7 Drawing Sheets

TILT-TOP MORTUARY COT

BACKGROUND OF THE INVENTION

The present invention relates to a cot, and more specifically to a tilt-top mortuary and ambulance cot that assists in the transfer of a body from a support bed of the cot to another surface.

Attendants having to move a human body from a support bed of a cot to another surface, such as an examining table, typically must lift the body at an elevated height. However, lifting the body from an elevated height increases the risk of back injury to the attendants due to its weight. Additionally, more frequently, there exists the instance when only a single attendant is available to transfer the body. In that instance, the most common way of transferring the body is for the attendant to reach across the elevated surface and pull the body from the trolley. This type of handling also puts the attendant at an increased risk of injury again due to the dead weight of the body.

Furthermore, typically a conventional cot is utilized to transport the body. Such conventional cot structures typically include, for example, a patient supporting cot frame and a wheeled undercarriage. The cot frame is secured directly to the wheeled undercarriage, wherein the cot frame may be raised and lowered relative to the undercarriage. Other conventional cot structures include, for example, arrangements wherein the cot frame is provided with legs mounting wheels at their lowermost ends, wherein the legs are collapsible as the cot is placed in the vehicle. While such cot structures have a wide range of utility, situations are encountered wherein it is impractical to transport the body to or from a transport vehicle utilizing any of the existing types of cots. For example, for locations that have narrow passageways, tortuous turns, or steep stairways, using a conventional cot to transfer the body is impracticable, especially when only the single attendant is present.

Accordingly, there is a need for a cot that decreases the risk to injury to an attendant when transferring a body situated thereon to another surface. Additionally, there is a need for an improved cot having a support bed which may be readily separated from the remainder of the cot for independent use, such as at locations having either narrow passageways, tortuous turns, or steep stairways, as well as being quickly and easily reattached to the cot.

BRIEF SUMMARY OF THE INVENTION

The above-mentioned needs are met by the present invention providing a cot having a tiltable support bed that is releasably secured to a trolley. The tiltable support bed assists in the transfer of a body to another surface by lessening the resulting transfer weight of the body that is situated thereon. A lower resulting transfer weight is provided by at least one tilt mechanism that has the ability to tilt the support bed at an angle. By tilting the support bed at an angle, less effort is required to move the body, thereby allowing the body to be slid or pulled from the support bed onto another surface. Additionally, the support bed may be removed from the trolley. When removed, the support bed can be rolled upright with wheels that are located at one end of the support bed. Accordingly, the support bed permits an attendant to remove a body from locations that are difficult to access with conventional cots with the conveniently rolling support bed. Furthermore, with the support bed removed from the trolley, the total weight carried by the attendant is lower. The support bed has handholds on all four sides thereby permitting it to be lifted and carried at various angles. To maintain the body within the support bed, a restraint catch may be provided within each handhold or a pin restraining system may be located under the support bed to which restraints may be attached. The support bed is shaped to pool bodily fluid, which may escape during transport. When the support bed is removed and not being used, a number of support beds can be stacked for storage due to their shape.

In accordance with an embodiment of the present invention, provided is a cot for assisting the transfer of a body from the cot to another surface. The cot comprises a trolley, a support bed carried by the trolley, and a tilting mechanism that tilts the support bed relative to the trolley.

In accordance with another embodiment of the present invention, provided is a support bed, comprising a molded non-porous material having a pair of elongated sloping side portions integrally formed between a raised headrest portion and a raised footrest portion, the portions together define a contoured shape.

In accordance with yet another embodiment of the present invention, provided is a cot for assisting the transfer of a body from the cot to another surface, comprising a height adjustable trolley, a rollable support bed releasably secured to the trolley, and a tilting mechanism which tilts the support bed relative to the trolley.

In accordance with still another embodiment of the present invention, provided is a method of facilitating the moving of a body from a cot to another surface, the cot having a support bed and a trolley, comprising providing a tilting mechanism adapted to tilt the support bed relative to the trolley. The method further includes tilting the support bed with the tilt mechanism to facilitate moving the body when carried by the support bed to another surface.

In accordance with still yet another embodiment of the present invention, provided is a method of forming a one-piece support bed for a cot, comprising distributing a thermoplastic material inside a mold which defines a one-piece support bed having a pair of elongated sloping side portions integrally formed between a raised headrest portion and a raised footrest portion, the portions together define a contoured shape. The method further includes continuously rotating the mold about its vertical and horizontal axes by a mechanical arm inside of an oven to uniformly distribute the thermoplastic material over the inside surface of the mold until the thermoplastic material becomes fused or cured and forms an outer skin with a fairly uniform thickness. The method further includes cooling the rotating mold until the thermoplastic material solidifies, and opening the mold to remove the one-piece support bed.

Other features of the present invention will be apparent in light of the description of the invention embodied herein.

BRIEF DESCRIPTION OF THE DRAWINGS

The following detailed description of the preferred embodiment of the present invention can be best understood when read in conjunction with the following drawings, where like structure is indicated with like reference numerals, and in which.

DETAILED DESCRIPTION OF THE PREFERRED EMBODIMENTS

Figure 1:
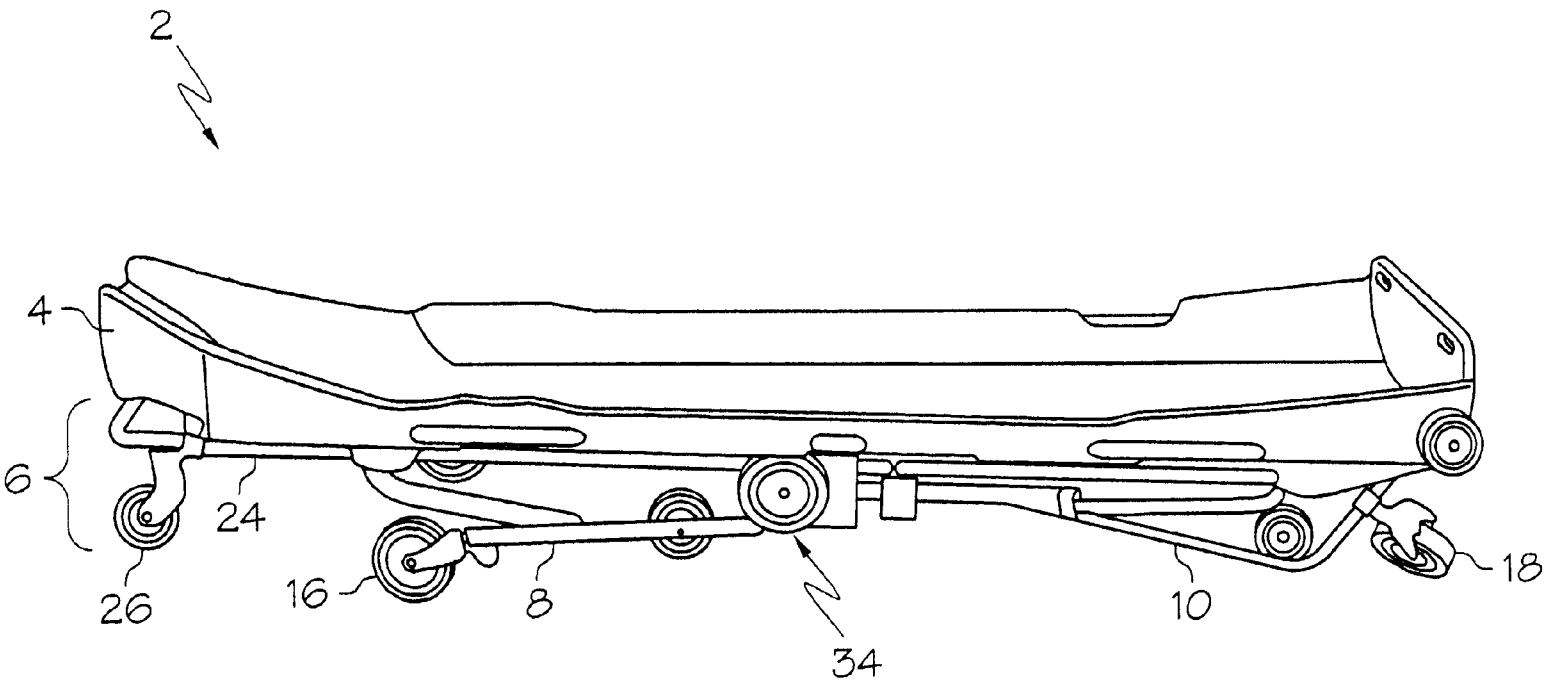
FIG. 1 is a plan view of a mortuary and ambulance cot according to an embodiment of the present invention showing the relationship of a support bed to an underlying trolley, the cot being in a lowered position.
Figure 2:
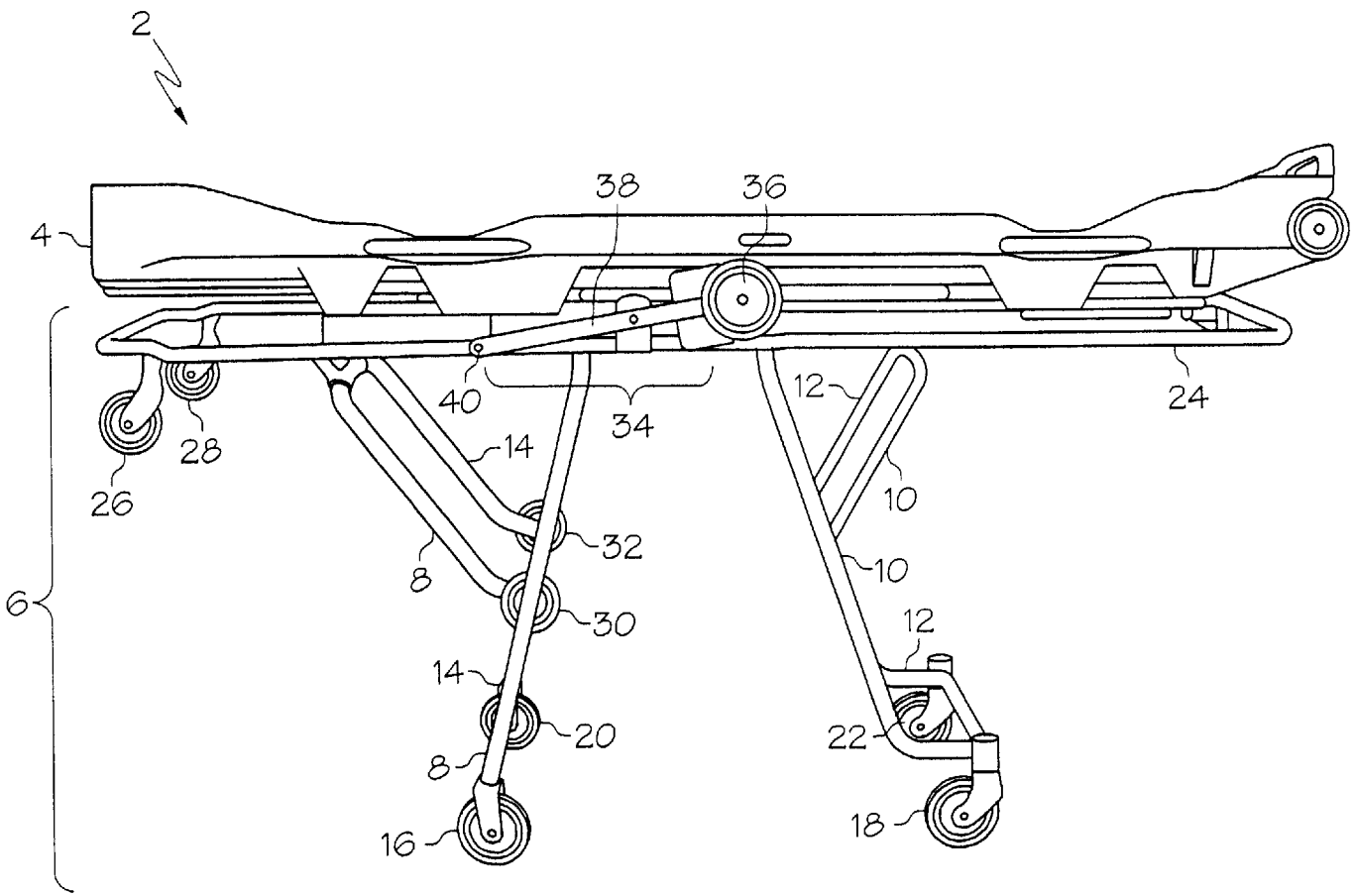
FIG. 2 is a plan view of the cot of FIG. 1, showing the cot being in a raised position.

Referring to FIGS. 1 and 2, illustrated in a lowered and raised position, respectively, is an exemplary cot 2 in accordance with the invention. The cot 2 includes a support bed 4 that is releasably secured to a trolley, indicted generally by 6. In the illustrated embodiment of FIG. 2, the trolley 6 comprises a roll-on type of cot having collapsible legs 8, 10, 12 and 14, of known construction, which support suitable caster wheels 16, 18, 20 and 22, respectively, at their lowermost ends. The legs 8, 10, 12 and 14 are pivotally connected to a supporting frame 24 to permit the cot 2 to be situated in either the lowered position as illustrated in FIG. 1, or the raised position as illustrated in FIG. 2. In the lowered position, the legs 8, 10, 12 and 14 are folded beneath the support frame 24, wherein in the raised position the legs 8, 10, 12, and 14 extend beneath the support frame 24. Caster wheels 26, 28, 30 and 32 may be provided on both the supporting frame 24 and a pair of legs 8, 14 to assist in rolling the cot into the back of a transport vehicle. Once the cot is rolled into the transport vehicle, the trolley 6 may be locked in place by any suitable fittings mounted to the cot, the transport vehicle or both, as is known by those in the art. It is to be understood, however, that the specific nature of the trolley 6 does not constitute a limitation on the invention. For example, the trolley 6 may take different forms, such as a standard wheeled rectangular undercarriage to which the supporting frame 24 is fixedly secured, or an elevating cot wherein adjustable or scissors-like leg members extend between the wheeled undercarriage and the supporting frame 24. It also will be understood that the trolley 6 may include various additional attachments and operating mechanisms for locking and unlocking the collapsible legs 8, 10, 12 and 14. Additionally, the trolley 6 may include mechanisms for raising and lowering the supporting frame 24 relative to the set of legs as all of which are known to the art and which have been eliminated from the drawings for simplicity in illustrating the invention.

The support bed 4 assists in the transfer of a body that is situated thereon to another surface by lowering the resulting transfer weight of the body. To facilitate lowering the resulting transfer weight of the body, the trolley 6 is provided with at least one tilt mechanism 34 for tilting the support bed 4. Preferably, a tilt mechanism 34 is provided to each longitudinal side 21 and 23 (FIG. 5) of the support frame 24 of the trolley 6 such that the support bed 4 may be tilted at an angle relative to either longitudinal side of the trolley. Alternatively, the tilt mechanism 34 may be centrally mounted to the trolley 6.

Figure 3:
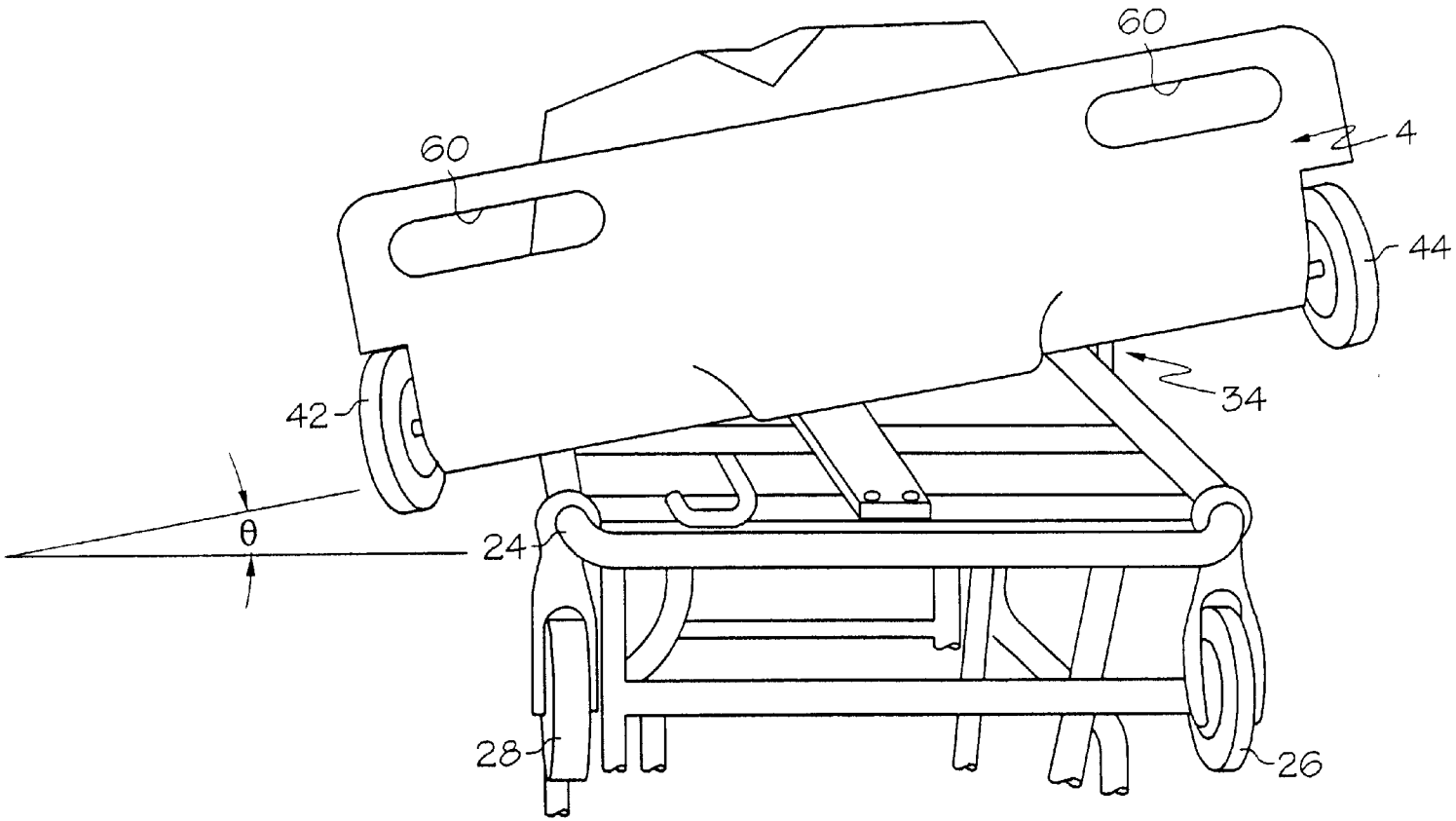
FIG. 3 is end view of the cot of FIG. 2, illustrating a tilted position according to an embodiment of the present invention.

As best illustrated in FIG. 2, the tilt mechanism 34 comprises a rotatable surface 36 rotatably mounted to a first end of an arm 38. The rotatable surface 36 may be a roller or preferably, a wheel or any other device that facilitates a rise in elevation of the support bed 4 such as, for example, a screw-lift mechanism, a hydraulic/pneumatic lift cylinder, and the likes. At a second end of the arm 38 provided is a handle 40 which an operator may manipulate to tilt the support bed 4. The arm 38 is mounted in a conventional fashion to the support frame 24 such that the arm may be pivoted relative to the support frame 24. Accordingly, with the tilt mechanism 34 in a first position, the support bed 4 rests completely upon the support frame as illustrated in FIG. 1. To tilt the support bed, the handle 40 is manipulated, causing the arm 38 and the rotatable surface 36 to pivot to a second position as illustrated in FIG. 2. The moving of the arm 38 from the first position (FIG. 1) to the second position (FIG. 2) engages the rotatable surface 36 with the underside of the support bed 4, thereby tilting the support bed 4 about the support frame 24. In the second position, the rotatable surface 36 tilts the support bed 4 to an angle θ above the support frame 24 as illustrated in FIG. 3. Angle θ is from about 10 degrees to about 50 degrees, and preferably, about 45 degrees. By tilting the support bed, a lower resulting force is required to move the body therefrom, thus allowing the body to be much more easily slid or pulled to another surface by an attendant.

Figure 4:
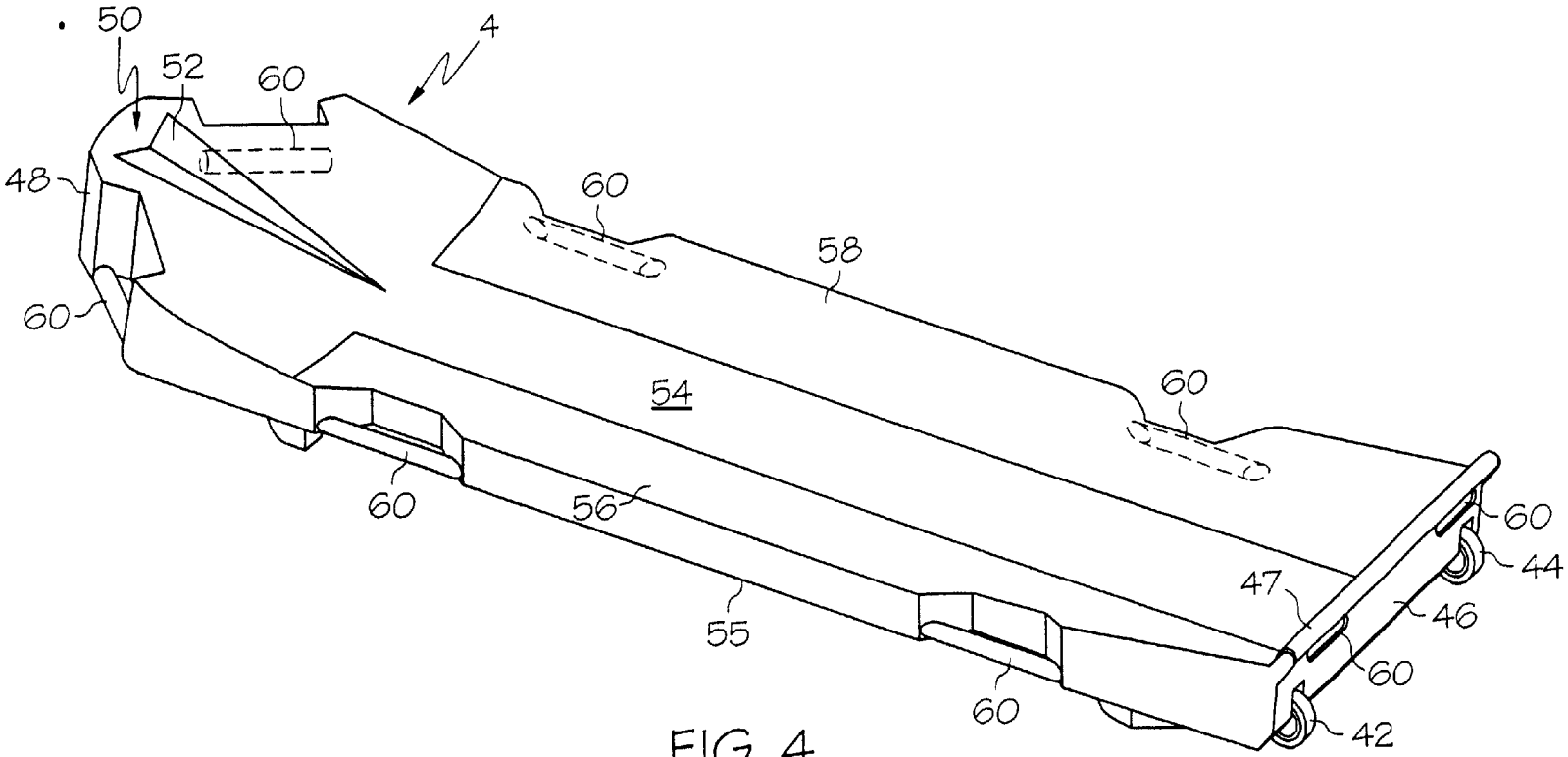
FIG. 4 is a top perspective view of the support bed of the cot of according to an embodiment of the present invention.

Turning now to FIG. 4, illustrated is the support bed 4 removed from the trolley 6. When removed, the support bed 4 can be rolled upright using wheels 42 and 44 that are located at a first end or footrest end 46 of the support bed. Accordingly, having a removable and rolling support bed 4 permits an attendant to remove a body from areas with difficult access. Furthermore, with the support bed 4 removed from the trolley 6, the total weight carried by the attendant is lower. To help with maneuvering and handling, the support bed 4 has a plurality of handholds 60 provided along its perimeter edge 55.

Figure 7:
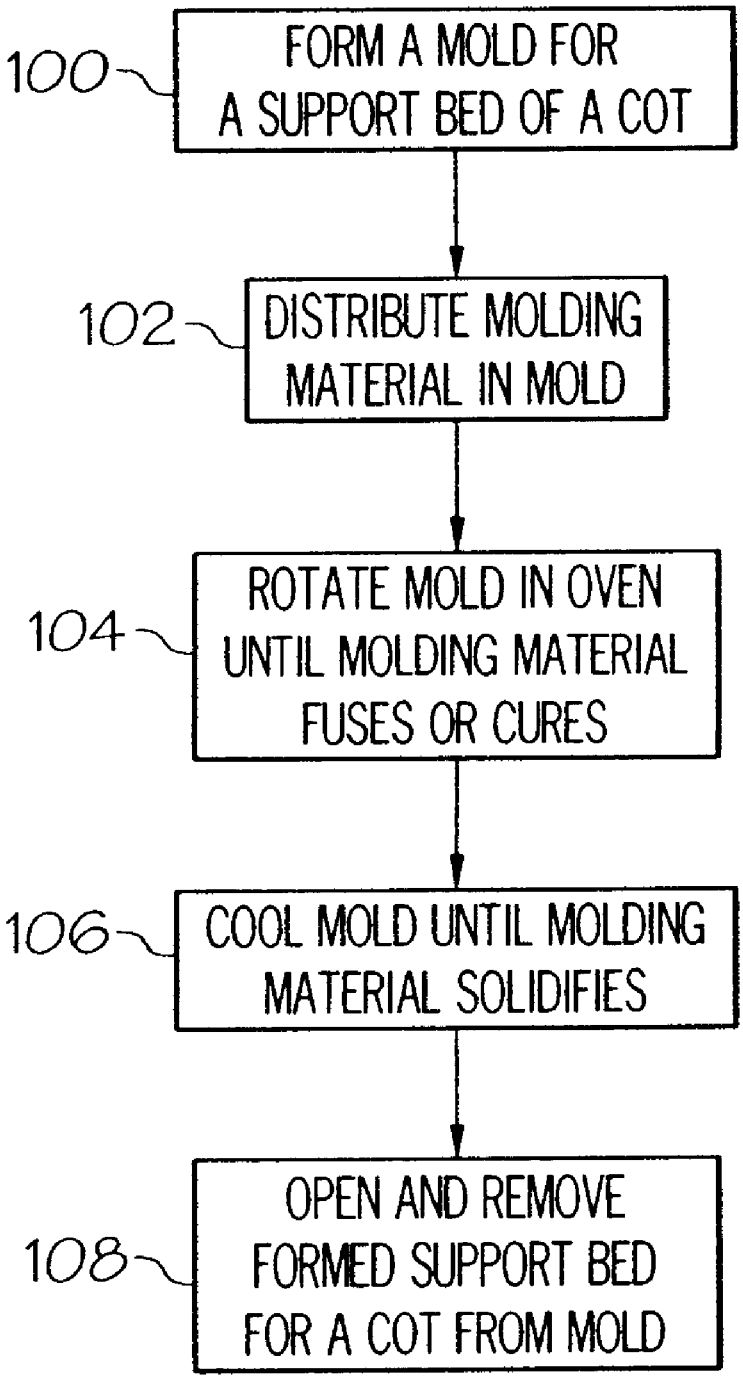
FIG. 7 illustrates a process for making a one-piece support bed for a cot.

The support bed 4 is made of a molded non-porous material, such as a polymer, and preferably, polyethylene plastic or other suitable material and utilizes a rotational molding procedure that allows the invention to be made in one continuous piece. Additionally, it is to be appreciated that using rotational molding permits the formation of both a lightweight and durable support bed 4. Although rotation molding is conventional, it is believed that no one has produced a support bed for a cot in this manner. As illustrated in FIG. 7, the creation of support bed 4 by way of rotation molding is as follows. In step 100, a two-piece aluminum casting or mold is made from a wood pattern. That is, sand used to make the mold is based off a urethane impression of the wood pattern. In step 102, a thermoplastic material, preferably polyethylene, in powdered or liquid form is placed into the bottom half of the mold. In step 104, the top half of the mold is secured in place, and then the mold is continuously rotated about its vertical and horizontal axes by a mechanical arm inside of an oven to uniformly distribute the thermoplastic material over the inside surface of the mold. In this step, the thermoplastic material becomes fused or cured and forms an outer skin with a fairly uniform thickness. In step 106, the rotating mold then goes/passes into cooling cycle/chamber where the thermoplastic material solidifies. After cooling, in step 108 the mold is then opened and the support bed is removed. This economical process produces a seamless, strong, one-piece support bed. This novel method of production of a support bed 4 of a cot is considered novel because it provides the benefits detailed above, and produces a support bed 4 that can act as a standalone support bed or be mounted/fixed to a trolley 6. Additionally, it is to be appreciated that forming the support bed by rotation molding also has a number of inherent design strengths, such as consistent wall thickness and strong corners that are virtually stress free. Furthermore, should additional strength be required, reinforcing ribs can be designed and molded into the support bed. Alternatively, the support bed may be blow molded and/or injection molded.

With regard to the shape of the support bed 4, adjacent the footrest end 46 of the support cot is a raised footrest portion 47 of the support bed 4. Adjacent a second end or headrest end 48 of the support bed 4 provided is a raised headrest portion 50. Integral with the headrest portion 50 is a stabilizing structure 52, preferably a tapered v-shaped channel. By stabilizing structure it is meant any structure that helps locate the head of a body, thereby preventing its movement. Between the footrest and headrest ends 46 and 48 of the support bed, provided is a center support portion 54. The center support portion 54 is integrally formed between a first and second elongated sloping side portion 56 and 58, respectively. Accordingly, it is to be appreciated that the support bed 4 is contoured in shape to pool bodily fluid, which may escape during transport. Additionally, it is to be appreciated that having both a raised headrest portion 50 and a stabilizing structure 52 further help the pooling of fluids to the center support portion 54 of the support bed 4, and/or prevent the release of fluids that may be located in the cavities of the body from orifices located in the body's head.

Figure 5:
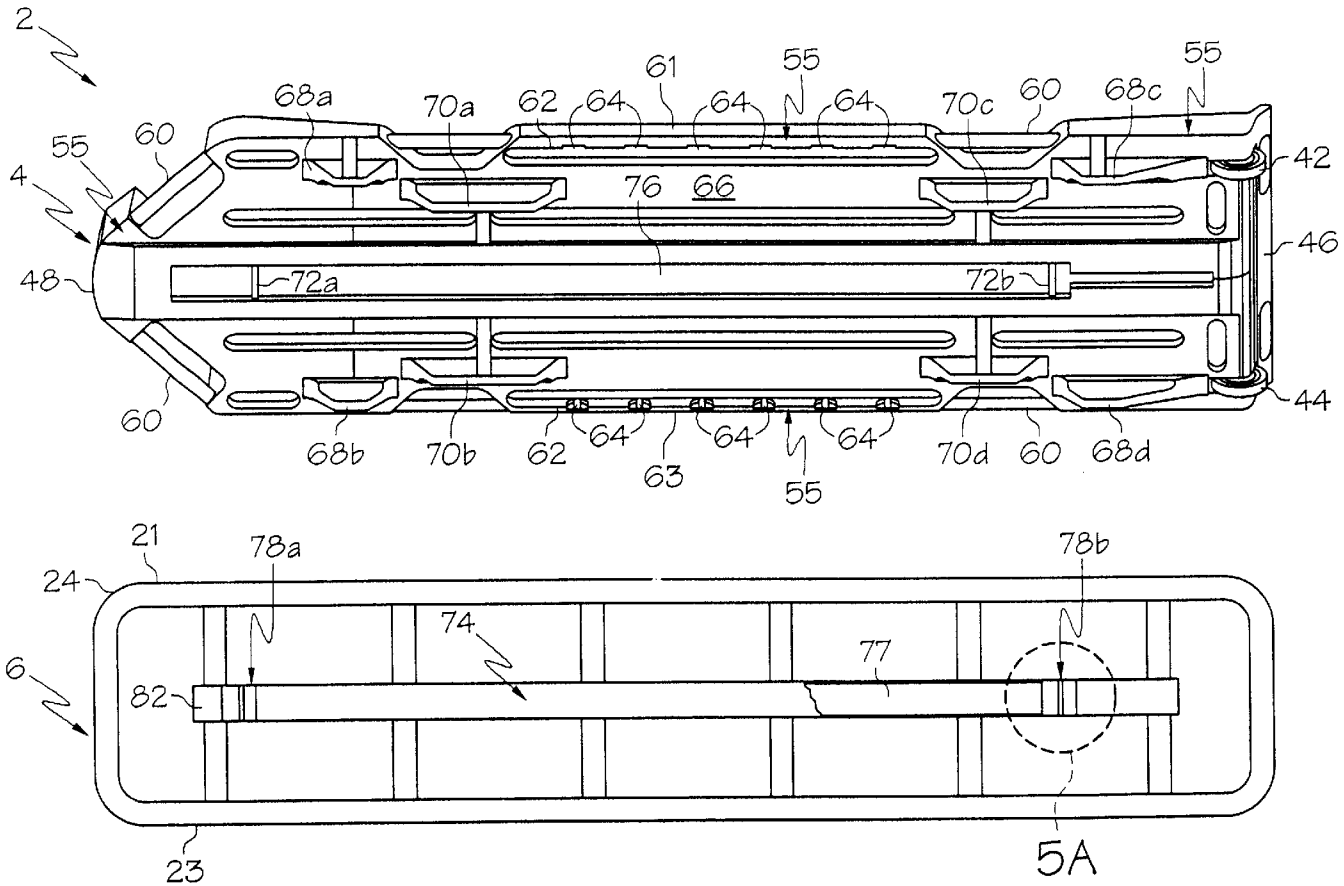
FIG. 5 is a bottom perspective view of the support bed illustrated in FIG. 4, and a top view of the trolley.
Figure 5A:
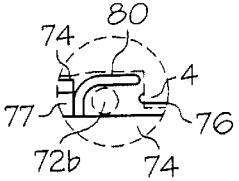

FIG. 5 shows the bottom of the support bed 4, and the top of the support frame 24 of the trolley 6. To maintain the body within the support bed 4, a restraint catch may be located in each of the plurality of handholds 60 or, preferably, a pin-restraining system 62 may be located under the support bed 4 to which restraints may be attached. The pin-restraining system 62 comprises a plurality of pins 64, which are integral with a bottom surface 66 of the support bed 4. Preferably, the pins 64 are provided along both longitudinal sides 61 and 63, adjacent the perimeter edge 55, of the support bed 4, as illustrated. It is to be appreciated that the pin-restraining system and/or catches permit a body to be secured to the bed support 4 with a crisscross pattern of restraints such as, for example, a restraint extending from the right shoulder area to the left hip area and another restraint extending from the left shoulder area to the right hip area. Alternatively, if desired, a straight-across pattern or any other local protocol for restraining a body could be followed given the number and location of the catches and pin-restraining system.

FIG. 5 also shows a first and second set of foot pedestals 68*a–d* and 70*a–d*, respectively, provided integrally with the bottom surface 66 of the support bed 4. The first set of foot pedestals 68*a–d* is positioned outboard and forward and aft of the second set of foot pedestals 70*a–d*. Accordingly, the spacing provided between the pairs of adjacent footrests of each set, 68*a* and 70*a*, 68*b* and 70*b*, 68*c* and 70*c*, and 68*d* and 70*d*, are such that the longitudinal sides 21 and 23 of the support frame 24 may be accommodated therebetween. It is to be appreciated that accommodating the longitudinal sides 21 and 23 of the support frame 24 between the respective pairs of adjacent footrest pedestals prevents the side-to-side movement of the support bed 4 when positioned upon the trolley 6. Additionally, situating the longitudinal sides 21 and 23 of the support frame 24 as such permits the support bed 4 to be tilted about one of the longitudinal sides 21 and 23 without having the support bed 4 slide sideways from the trolley 6.

To firmly secure the support bed 4 to the trolley 6, the support bed 4 further includes at least a pair of pins 72 integrally formed with the support bed on the bottom surface 66. A first pin 72*a* is located near the headrest end 48, and a second pin 72*b* is located near the footrest end 46. A securing device 74 is provided to the trolley 6 that releasably secures each of the pair of pins 72 of the support bed 4. To provide additional lateral constraint when the support bed 4 is situated on the trolley 6, the securing device 74 is accommodated within a long central slot 76. The slot 76 is formed integral to the bottom surface 66 of the bed support 4, and to which the pair of pins 72 span.

A sliding bar 77, partially shown, is slidably accommodated within the securing device 72. Each of the pins 72*a* and 72*b* is secured by the sliding bar 77 within an associated engagement position 78*a* and 78*b*, respectively. As shown by the enlarged side view of the engagement position 78*b* of the securing device 74, a prong member 80 of the sliding bar 77 is sized and shaped to capture its associated pin 72*b* of the support bed 4, illustrated by the dashed line, when placed upon the trolley 6. The sliding bar 77 is spring biased toward the capturing or secured position, as illustrated. In the secured position, the prongs 80 of the sliding bar 77 overlap the top of the pins, locking the support bed 4 onto the trolley 6.

Turning back to the full view of FIG. 5, a handle 82 of the securing device 74 permits an attendant to move the sliding bar 77 from the secured position to a released position (not shown). In the released position, the prongs 80 of the sliding bar 77 slide away from their associated pins 72*a* and 72*b*, respectively, permitting the support bed to be lifted from the trolley 6. It is to be appreciated that the securing device 74 must be disengaged in order to tilt the support bed 4.

Figure 6:
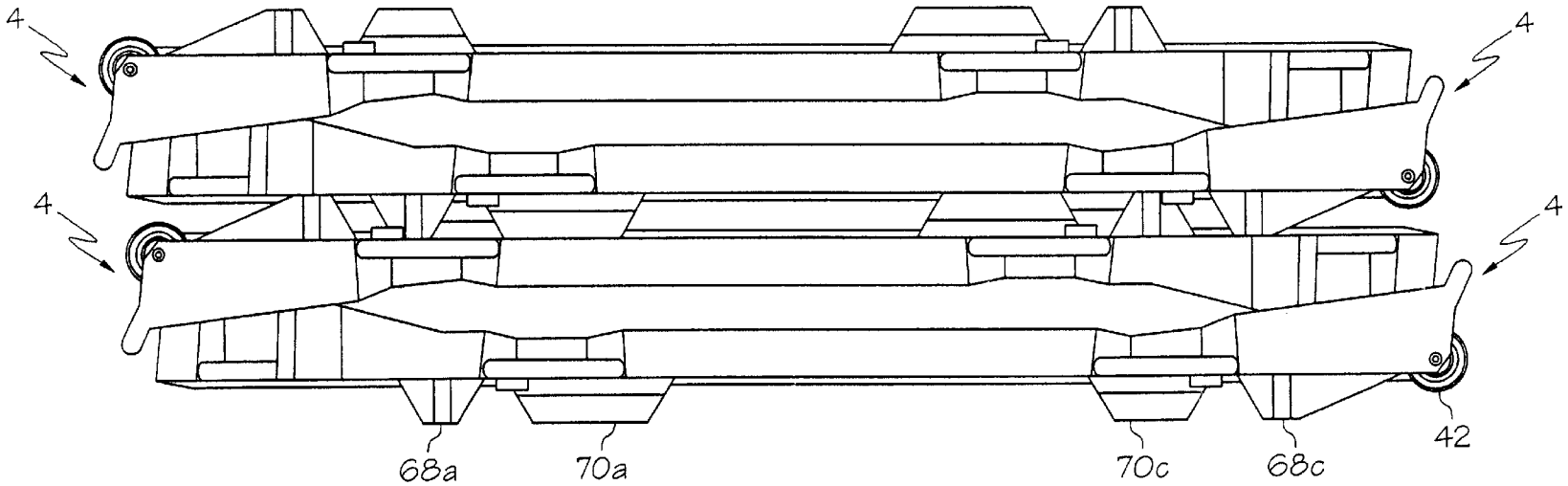
FIG. 6 is an elevated perspective view of stacked support beds according to an embodiment of the present invention.

As illustrated in FIG. 6, when the support bed 4 is removed from the trolley 6, a number of support beds 4 may be nested for storage due to their shape.

As should now be evident, the instant invention provides a versatile cot, which is capable of performing additional functions normally requiring at least two distinct pieces of equipment. When the trolley 6 and support bed 4 are locked together, the unit functions as a conventional mortuary and/or ambulance cot and, as previously indicated, the trolley 6 may take various forms, as may the support top 4, thereby providing a wide range of versatility depending upon the functions to be performed by the unit.

As should be additionally evident, the versatile cot may be conveniently used with live patients in emergency situations, such as transferring a patient from an emergency vehicle to a hospital. In such situations, the cot would be versatile in facilitating the patient transfer from the support bed to a hospital bed or operating table.

Having described the invention in detail and by reference to preferred embodiments thereof, it will be apparent that modifications and variations are possible without departing from the scope of the invention defined in the appended claims.

What is claimed is:

1. A cot for assisting the transfer of a body from the cot to another surface, comprising:

a trolley;

a removable support bed carried by said trolley; and a tilting mechanism to tilt said support bed sideways relative to said trolley.

2. The cot of claim 1, wherein said tilting mechanism includes a lever arm rotatably mounted to said trolley, said lever arm movable from a first position to a second position wherein at said second position said support bed is tilted.

3. The cot of claim 2, wherein said lever arm at a first end has a rotatable surface which engages said support bed between said first and second positions tilting said support bed.

4. The cot of claim 2, wherein said support bed is adapted to be tilted from about 10 degrees to about 50 degrees.

5. The cot of claim 3, wherein said rotatable surface is a wheel.

6. The cot of claim 1, wherein said support bed is contoured in shape to pool fluids that may escape from the body.

7. The cot of claim 1, wherein said support bed includes rollers at a first end.

8. The cot of claim 6, wherein said support bed includes rollers at a first end.

9. The cot of claim 6, wherein said support bed includes a plurality of handgrips positioned adjacent a perimeter edge of said support bed.

10. The cot of claim 6, wherein said support bed includes a restraining system having a plurality of pins.

11. The cot of claim 10, wherein said pins are provided on a bottom surface of said support bed and along each longitudinal side of said support bed.

12. The cot of claim 1, wherein said support bed includes a securing device that engages said trolley to removably attach said support bed to said trolley.

13. The cot of claim 1, wherein said support bed is rotation molded from polyethylene plastic.

14. A support bed used to transport a body and adapted for use with a trolley, comprising a one-piece molded non-porous material having a pair of elongated sloping side portions integrally formed between a raised headrest portion and a raised footrest portion, said portions together define a contoured shape.

15. The support bed as defined in claim 14, wherein said footrest portion includes a pair of rollers.

16. The support bed as defined in claim 14, wherein said support bed has a bottom surface that is adapted to be releasably secured to the trolley.

17. The support bed as defined in claim 14, wherein said raised headrest portion includes a stabilizing structure for stabilizing a head of the transported body.

18. The support bed as defined in claim 17, wherein said stabilizing structure is a v-groove channel provided in said raised headrest portion.

19. The support bed as defined in claim 14, wherein said support bed has a perimeter edge and further includes a plurality of handgrips provided adjacent said perimeter edge.

20. The support bed as define in claim 14, wherein said support bed has a bottom surface and said bottom surface is provided with a pin-restraining system.

21. A cot for assisting the transfer of a body from the cot to another surface, comprising:

a height adjustable trolley;

a rollable support bed releasably secured to said trolley; and a tilting mechanism to tilt said support bed sideways relative to said trolley.

22. A method of facilitating the moving of a body from a cot to another surface, the cot having a removable support bed and a trolley, comprising:

providing a tilting mechanism to tilt the support bed sideways relative to the trolley, said tilt mechanism having a level arm with a rotatable surface; and tilting the support bed sideways by manually operating the tilt mechanism such that said rotatable surface engages and rides under said support bed to facilitate moving the body when carried by the support bed to another surface.

23. A method of forming a one-piece support bed for a cot, comprising:

distributing a thermoplastic material inside a mold which defines a one-piece support bed having a pair of elongated sloping side portions integrally formed between a raised headrest portion and a raised footrest portion, said portions together define a contoured shape;

continuously rotating said mold about its vertical and horizontal axes by a mechanical arm inside of an oven to uniformly distribute said thermoplastic material over the inside surface of said mold until said thermoplastic material becomes fused or cured and forms an outer skin with a fairly uniform thickness;

cooling said rotating mold until said thermoplastic material solidifies; and opening said mold to remove the one-piece support bed.

24. A cot for assisting the transfer of a body from the cot to another surface, comprising:

a trolley;

a removable support bed carried by said trolley, said support bed contoured in shape to pool fluids that may escape from the body, said support bed includes a restraining system having a plurality of pins; and a tilting mechanism adapted to tilt said support bed relative to said trolley.

25. A one-piece support bed used to transport a body and adapted for use with a trolley, comprising a molded non-porous material having a pair of elongated sloping side portions integrally formed between a raised headrest portion and a raised footrest portion, said portions together define a contoured shape, a plurality of handgrips provided adjacent a perimeter edge, and a restraint catch located in each of said plurality of handholds.

26. The one-piece support bed of claim 25, wherein said support bed is adapted to be releasably securable to the trolley by a securing mechanism.

* * * * *